US008714257B2

(12) United States Patent
Kitzman

(10) Patent No.: US 8,714,257 B2
(45) Date of Patent: May 6, 2014

(54) PULSE FRACTURING DEVICES AND METHODS

(75) Inventor: Jeffery D. Kitzman, Conroe, TX (US)

(73) Assignee: Baker Hughes Incorporated, Houston, TX (US)

( * ) Notice: Subject to any disclaimer, the term of this patent is extended or adjusted under 35 U.S.C. 154(b) by 350 days.

(21) Appl. No.: 13/240,942

(22) Filed: Sep. 22, 2011

(65) Prior Publication Data

US 2013/0075099 A1 Mar. 28, 2013

(51) Int. Cl.
*E21B 43/26* (2006.01)

(52) U.S. Cl.
USPC ..... 166/308.1; 166/177.5

(58) Field of Classification Search
USPC ..... 166/308.1, 177.5
See application file for complete search history.

(56) References Cited

U.S. PATENT DOCUMENTS

| | | | | |
|---|---|---|---|---|
| 2,915,122 | A | 12/1959 | Hulse | |
| 3,933,205 | A | 1/1976 | Kiel | |
| 4,617,997 | A | 10/1986 | Jennings | |
| 4,714,114 | A | 12/1987 | Jones | |
| 4,718,490 | A | 1/1988 | Uhri | |
| 4,751,966 | A | 6/1988 | Jones | |
| 5,005,649 | A * | 4/1991 | Smith et al. | 166/308.1 |
| 5,228,510 | A | 7/1993 | Jennings | |
| 6,575,242 | B2 * | 6/2003 | Woie | 166/250.02 |
| 7,559,373 | B2 | 7/2009 | Jackson | |
| 7,810,570 | B2 * | 10/2010 | Collins et al. | 166/308.1 |
| 2008/0271923 | A1 * | 11/2008 | Kusko et al. | 175/25 |
| 2009/0294121 | A1 * | 12/2009 | Leon et al. | 166/248 |
| 2011/0011592 | A1 | 1/2011 | Leon | |
| 2011/0108276 | A1 | 5/2011 | Spence | |
| 2011/0155377 | A1 | 6/2011 | Laun | |
| 2011/0174491 | A1 | 7/2011 | Ravensbergen | |

OTHER PUBLICATIONS

Check Valves,Excess Flow Check Series, REGO Cryo-Flow Products, Division of Engineered Controls International, Inc., 1 page, undated.

http://schou.dk/animation/, Hydraulic Ram Animation, 2000,pp. 1-2.

http://www.clemson.edu/irrig/equip/ram4.htm, How a Hydraulic Ram Pump works, 2007, pp. 1-4.

http://www.nov.com/Well_Service_and_Completion/Coiled_Tubing/NOV_CTES_-_Cement_Pulsation.aspx, NOV CTES, Cement Pulsation, National Oilwell Varco, Jul. 7, 2011, 3 pages.

Carlson, Jon, et al, Sand Control: Why and How? Completion/Stimulation, Oct. 1992, pp. 41-53.

http://en.wikipedia.org/w/index.php?title=Hydraulic_ram&printable=yes, Hydraulic Ram—Wikipedia, Sep. 12, 2011, pp. 1-5.

* cited by examiner

*Primary Examiner* — William P Neuder
(74) *Attorney, Agent, or Firm* — Parsons Behle & Latimer

(57) ABSTRACT

A pulse fracturing device includes a normally open first valve and a normally closed second valve in a housing. The first valve is configured to close at a predetermined level of hydrodynamic force exerted on the first valve and to open when the force drops below the predetermined level. The first valve, when open, is configured to allow fluid flow out from the housing. The second valve is configured to open at a predetermined pressure within the housing and to close when pressure drops below the predetermined pressure. The second valve, when open, is configured to allow fluid flow out from the housing.

20 Claims, 10 Drawing Sheets

PULSE FRACTURING DEVICES AND METHODS

BACKGROUND

1. Field of the Disclosure

The embodiments described herein relate generally to pulse fracturing devices and methods, for example, to a dual valve device configured to produce cyclic pulses of increased pressure in a well bore.

2. Description of the Related Art

Fracture stimulation, a known practice in the oil and gas industry, may be used to increase the production of hydrocarbons from wells, such as in lower quality reserves. Known practices include forming a well bore in a subterranean formation and inserting a well casing in the well bore. Horizontal well bores may be formed to increase the extent to which a single well bore may reach desired regions of a formation. Horizontal wells as a percentage of newly drilled wells continue to rise. Multiple fracture stages may be implemented in a single well bore to increase production levels and provide effective drainage. Perforations in sections of a well casing allow fracturing fluid at high pressure to initiate and then propagate a fracture in the formation during each stage. A proppant included in the fracturing fluid may lodge in the fracture to keep it propped open after fracturing, increasing conductivity. For effective fracturing, one section may be fractured at a time by hydraulically isolating other perforated sections. A variety of mechanisms, e.g. bridge plugs, and materials, e.g. sand plugs, are known to allow hydraulic isolation.

Techniques have been developed whereby perforating and fracturing operations are performed with a coiled tubing string. One such technique is known as the Annular Coil Tubing Fracturing Process, or the ACT-Frac Process for short, disclosed in U.S. Pat. Nos. 6,474,419, 6,394,184, 6,957,701, and 6,520,255. To practice the techniques described in the aforementioned patents, the work string, which includes a bottom hole assembly (BHA), generally remains in the well bore during the fracturing operation. One method of perforating, known as the sand jet perforating procedure, involves using a sand slurry to blast holes through the casing, through the cement, and into the well formation. Then fracturing can occur through the holes.

Well completion techniques that do not involve perforating are known in the art. One such technique is known as packers-plus-style completion. Instead of cementing the completion in, this technique involves running open-hole packers into the well hole to set the casing assembly. The casing assembly includes ported collars. After the casing is set in the well, the ports can be opened. Fracturing can then be performed through the ports.

A variety of mechanisms and systems have been devised to allow fracturing in selected sections of a well bore by opening selected ports. Examples are described in U.S. patent application Ser. No. 12/842,099 entitled "BOTTOM HOLE ASSEMBLY WITH PORTED COMPLETION AND METHODS OF FRACTURING THEREWITH," filed Jul. 23, 2010, by Lyle E. Laun and John Edward Ravensbergen, which is incorporated by reference herein in its entirety. Another technique for fracturing wells without perforating is described in U.S. patent application Ser. No. 12/826,372 entitled "JOINT OR COUPLING DEVICE INCORPORATING A MECHANICALLY-INDUCED WEAK POINT AND METHOD OF USE," filed Jun. 29, 2010, by Lyle E. Laun.

Whether fracturing fluid flows through casing perforations or ports, it is known to fracture using pulses of increased pressure instead of just sustained or ramping pressure. U.S. Pat. No. 2,915,122 issued to Hulse describes applying cyclic pressure shocks to form a greater plurality of relatively small fractures using an air hammer or piston at the well head. U.S. Patent Application Publication No. 2011/0108276 by Spence et al. (hereinafter "Spence et al.") describes applying repeated pressure pulses to enhance formation dilations. Spence et al. uses a plug that temporarily seals against a die in a wellbore and increases pressure until the plug passes through the die, releasing the increased pressure to the target formation. U.S. Pat. No. 5,005,649 issued to Smith et al. describes applying a pressure pulse to form multiple fractures in a fracture zone using rupture discs on high-pressure tubing. Accordingly, further advancement in pulse fracturing devices and methods may be of benefit.

SUMMARY

According to one embodiment, a pulse fracturing device includes an upper isolation mechanism, a lower isolation mechanism, and a housing at least a portion of which is between the upper isolation mechanism and the lower isolation mechanism. The upper and lower isolation mechanisms are configured to isolate a portion of a well casing. The device includes a normally open first valve and a normally closed second valve in the housing. The first valve is configured to close at a predetermined level of hydrodynamic force exerted on the first valve and to open when the force drops below the predetermined level. The first valve, when open, is configured to allow fluid flow out from the housing between the upper isolation mechanism and the lower isolation mechanism. The second valve is configured to open at a predetermined pressure within the housing and to close when pressure drops below the predetermined pressure. The second valve, when open, is configured to allow fluid flow out from the housing between the upper isolation mechanism and the lower isolation mechanism.

According to another embodiment, a pulse fracturing device includes an extension housing having a first discharge opening through a wall of the extension housing. The device includes an excess flow valve including a sliding sleeve within the extension housing and a pressure relief valve including a flap mounted on the extension housing over a fluid outlet through the wall of the extension housing. The sliding sleeve has a second discharge opening through a wall of the sliding sleeve. The excess flow valve is biased in an open position with the first discharge opening aligned with the second discharge opening. The open position is configured to allow fluid discharge through the wall of the extension housing. The relief valve is biased in a closed position.

According to a further embodiment, a pulse fracturing method includes positioning an upper packer, a lower packer, and an extension housing in a well casing in a subsurface formation. At least a portion of the extension housing is between the upper packer and the lower packer. The method includes isolating a portion of the well casing between the upper and lower packers and flowing fracturing fluid through a hydraulic ram to the isolated well casing. The hydraulic ram is located in the extension housing. The hydraulic ram cyclically produces pulses of increased pressure originating from the hydraulic ram. The method further includes fracturing the subsurface formation using the fracturing fluid and pressure pulses.

Figure 1:
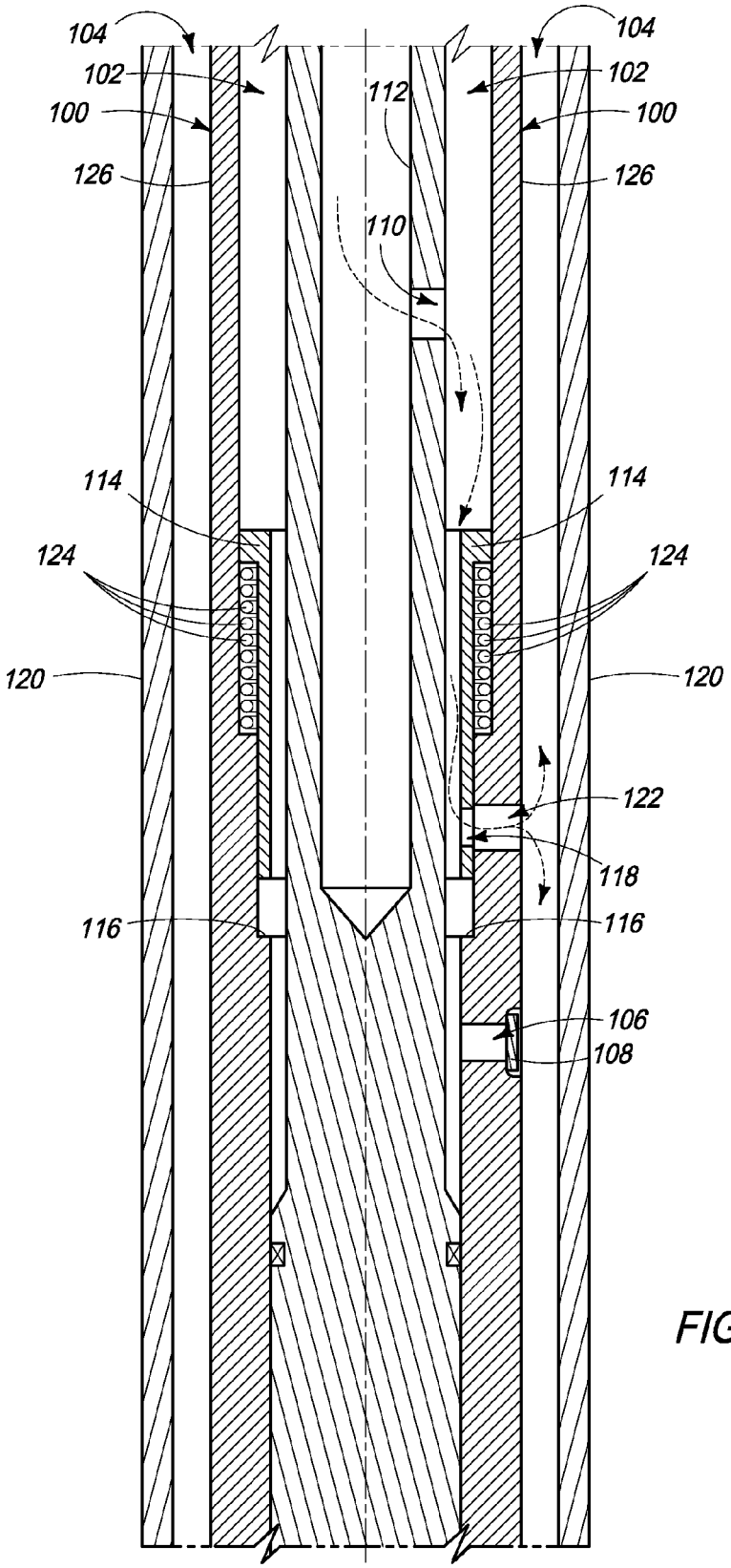
FIGS. 1-4 show partial cross-sectional views of a pulse fracturing device, according to an embodiment, in a well casing at sequential stages of a cycle that produces a pulse of increased pressure.

While the disclosure is susceptible to various modifications and alternative forms, specific embodiments have been shown by way of example in the drawings and will be described in detail herein. However, it should be understood that the disclosure is not intended to be limited to the particular forms disclosed. Rather, the intention is to cover all modifications, equivalents and alternatives falling within the scope of the invention as defined by the appended claims.

DETAILED DESCRIPTION

Along with the other advantages of pulse fracturing discussed in the Background section above and the references cited therein, pulse fracturing has the additional potential benefit of fatiguing a subsurface formation. By fatiguing a formation with pulsing fracturing fluid, devices and methods disclosed herein may allow fracturing to occur at a lower pressure than used in a fracturing method without pulsing. The extent of fatigue exerted on a formation and the accompanying reduction in suitable fracturing pressure may depend on the formation's composition and the pulsing parameters, among other considerations.

The composition of some formations may be such that only a large amount of increased pressure in a pulse results in a noticeable decrease in fracturing pressure. Other formation compositions may be more susceptible and allow noticeable decreases in fracturing pressure with a smaller amount of increased pressure in a pulse. As will be appreciated from the disclosure herein, the devices and methods described may be configured to be suitable for use in a wide range of fracturing pressure applied to formations and are thus applicable to a variety of formation compositions. Also, with knowledge of the principles disclosed herein, pulse fracturing devices may be designed to produce a range of increased pressure in the pulses generated.

According to one embodiment, a pulse fracturing device includes an upper isolation mechanism, a lower isolation mechanism, and a housing at least a portion of which is between the upper isolation mechanism and the lower isolation mechanism. The upper and lower isolation mechanisms are configured to isolate a portion of a well casing. The device includes a normally open first valve and a normally closed second valve in the housing. The first valve is configured to close at a predetermined level of hydrodynamic force exerted on the first valve and to open when the force drops below the predetermined level. The first valve, when open, is configured to allow fluid flow out from the housing between the upper isolation mechanism and the lower isolation mechanism. The second valve is configured to open at a predetermined pressure within the housing and to close when pressure drops below the predetermined pressure. The second valve, when open, is configured to allow fluid flow out from the housing between the upper isolation mechanism and the lower isolation mechanism.

By way of example, the first valve may include an excess flow valve. The second valve may include a pressure relief valve. The excess flow valve and/or the pressure relief valve may be of a known design or may be according to one of the designs disclosed herein. Accordingly, the housing may include a first discharge opening through a wall of the housing and the first valve may include a sliding sleeve within the housing. The sliding sleeve may have a second discharge opening through a wall of the sliding sleeve. With the first valve open, the first discharge opening may be aligned with the second discharge opening. Additionally, the first valve may be biased open by a spring, for example, a coil spring. The second valve may include a flap mounted on the housing over a fluid outlet through the wall of the housing. The second valve may be biased closed. A known variety of flapper valve or the like may be suitable.

The upper and lower isolation mechanisms may include upper and lower packers. The housing may include an extension housing of a gravel pack system. The pulse fracturing device may further include a crossover tool inserted into the extension housing to form an inner annulus between the crossover tool and the extension housing. The first valve may be within the inner annulus. The crossover tool may include a fluid inlet into the inner annulus such that, with the first valve or the second valve in an open position, a fluid flow path is provided. The fluid flow path may be from the crossover tool, through the fluid inlet, through the inner annulus, and through a wall of the extension housing. Instead of the first valve being within the inner annulus, it is conceivable that the first valve may be in the crossover tool. The second valve may additionally be in the crossover tool or may be in the extension housing, but not in the crossover tool.

According to another embodiment, a pulse fracturing device includes an extension housing having a first discharge opening through a wall of the extension housing. The device includes an excess flow valve including a sliding sleeve within the extension housing and a pressure relief valve including a flap mounted on the extension housing over a fluid outlet through the wall of the extension housing. The sliding sleeve has a second discharge opening through a wall of the sliding sleeve. The excess flow valve is biased in an open position with the first discharge opening aligned with the second discharge opening. The open position is configured to allow fluid discharge through the wall of the extension housing. The relief valve is biased in a closed position.

The device may further include a crossover tool inserted into the extension housing to form an inner annulus between the crossover tool and the extension housing. The sliding sleeve may be within the inner annulus and the crossover tool may include a fluid inlet into the inner annulus such that, with the excess flow valve or the relief valve in an open position, a fluid flow path is provided from the crossover tool, through the fluid inlet, through the inner annulus, and through the wall of the extension housing.

By way of example, the excess flow valve may be biased in the open position by a spring between the sliding sleeve and the extension housing. The spring may be a coil spring with its coils around the sliding sleeve. The excess flow valve may be configured to close at a predetermined level of hydrodynamic force exerted on the excess flow valve and to open when force drops below the predetermined level. The pressure relief valve may be configured to open at a predetermined pressure within the extension housing and to close when pressure drops below the predetermined pressure.

The pulse fracturing device may further include a packer. At least a portion of the extension housing may be downhole from the packer. The packer may be configured to isolate a portion of a well bore downhole from the packer. The first and second discharge openings and the fluid outlet may be downhole from the packer.

FIGS. 1-4 show partial cross-sectional views of one embodiment of a pulse fracturing device. The pulse fracturing device is shown in a well casing at sequential stages of a cycle that produces a pulse of increased pressure. The portion of the pulse fracturing device shown in FIGS. 1-4 may be incorporated into a variety of apparatuses. Such apparatuses may be configured for use in cased holes or open holes. The apparatuses may be a part of a well completion assembly used first for hydrofracturing and subsequently for production, such as a gravel pack system, or may be part of a hydrofracturing assembly just for the purpose of hydrofracturing that is subsequently removed from the well bore. A pulse fracturing device might be included in other apparatuses suitable for operation downhole in a well bore.

FIGS. 1-4 do not show any packer configured to isolate a portion of the well bore downhole from such a packer. It is conceivable for the pulse fracturing device to function without a packer. However, a known packer suitable for use in the particular type of cased or open hole and compatible with operation of the pulse fracturing device may be used. Provision of at least one packer may increase effectiveness of pulse fracturing by isolating pressure pulses to a particular section downhole from the packer. Further, in some applications, an upper packer and a lower packer may be used to most effectively isolate a section to be fractured, especially when the target section is not at total depth. Known packers may also be used for the lower packer.

Figure 10:
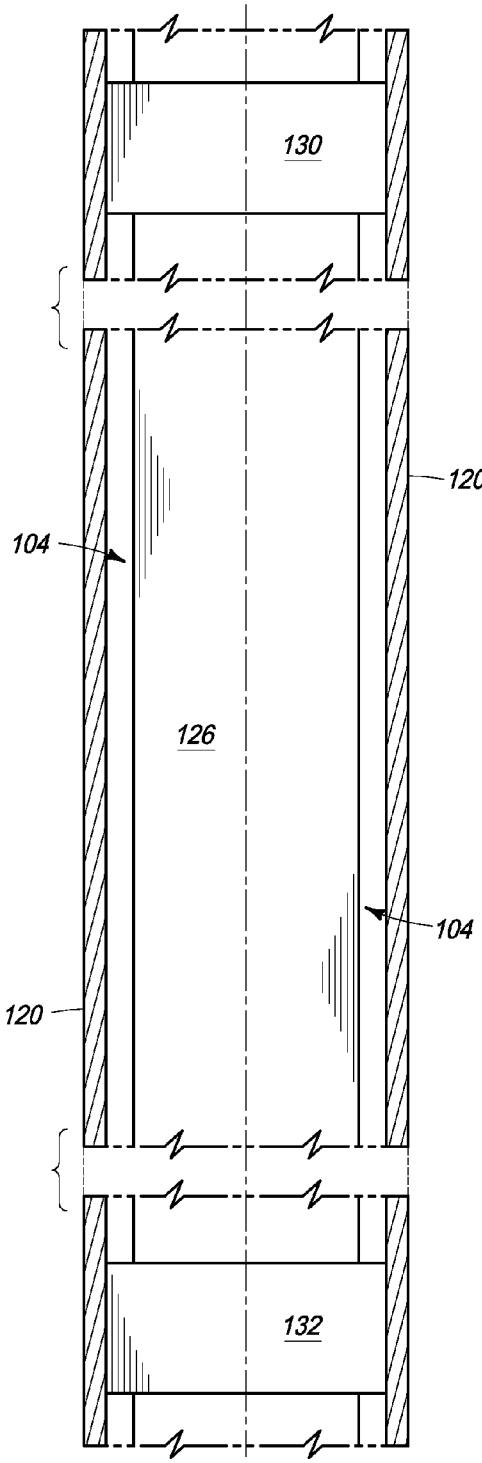
FIG. 10 shows a portion of a pulse fracturing device, according to an additional embodiment, in a cut-away view inside a well casing.
Figure 11:
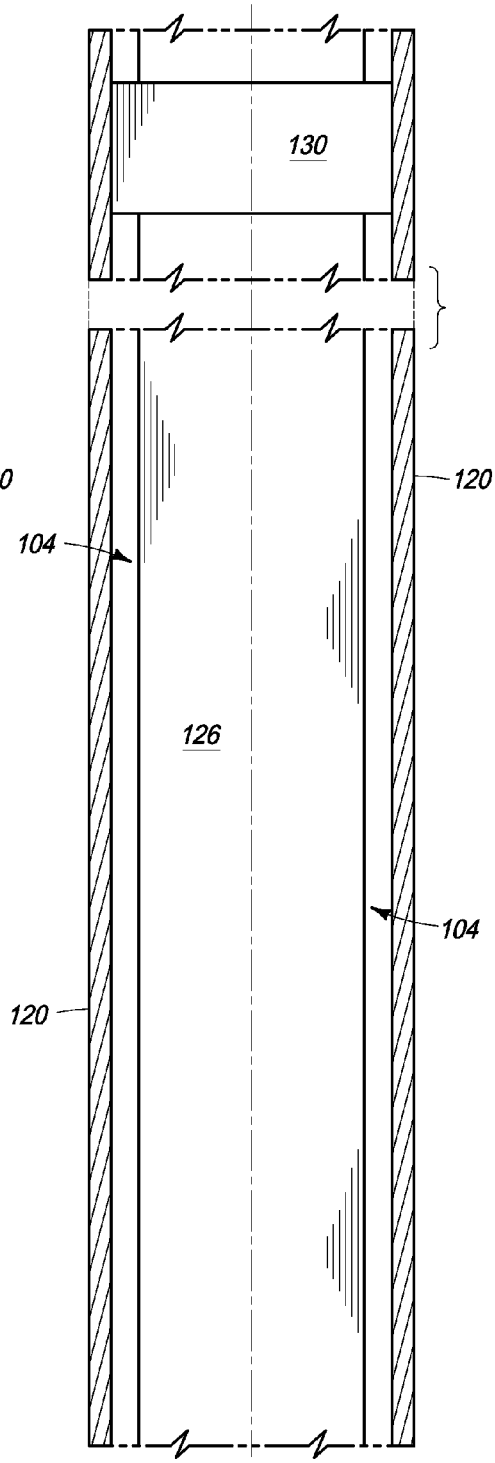
FIG. 11 shows a portion of a pulse fracturing device, according to a further embodiment, in a cut-away view inside a well casing.

FIGS. 10 and 11 show housing 126 of pulse fracturing devices, according to two embodiments, within a section of casing 120 cut-away for viewing inside. An outer annulus 104 is between casing 120 and housing 126. The devices in both FIGS. 10 and 11 provide at least one isolation mechanism, shown as at least one packer, namely, upper packer 130. The device in FIG. 10 further includes a lower packer 132, while the device in FIG. 11 does not.

FIG. 1 shows a pulse fracturing device 100 within a section of casing 120. Casing 120 is not shown with perforations or ports in the particular cross section selected for FIG. 1. However, it will be understood that perforations or ports in casing 120 are present within, above, or below the section shown in FIG. 1 to allow fluid communication to a subsurface formation in which casing 120 is inserted. As explained in the Background section above, a variety of perforation or porting technologies may be applicable.

The subject matter of U.S. patent application Ser. No. 12/842,099 incorporated by reference above describes casing lengths coupled by at least one collar. The collar has a fracture port configured to open by applying a pressure differential between two apertures in the collar and is included in OPTIPORT coiled-tubing frac sleeve technology available from Baker Hughes Inc. in Houston, Tex. Some of the embodiments described herein may be configured to function efficiently in conjunction with OPTIPORT technology. That is, the structures used for pulse fracturing device 100 may be incorporated into the device used in OPTIPORT technology to open the fracture port in the collar.

An outer annulus 104 between pulse fracturing device 100 and casing 120 receives fracturing fluid, which may contain proppant, from device 100. Fracturing fluid flows through outer annulus 104, through perforations or ports (not shown) in casing 120 and ultimately into a subsurface formation. Device 100 includes a crossover tool 112 inserted into a housing 126, also referred to in the art as an "outer string." Housing 126 may be an extension housing known for employment with a gravel pack system. Generally speaking, a gravel pack extension may be used to add a desired functionality to a gravel pack system. Examples include extensions to enable gravel packing in open holes, to enable hydrofracturing with the gravel pack system, to provide operational flexibility in gravel packing circulation modes, etc.

In FIG. 1, fracturing fluid along with proppant, if any, flows through crossover tool 112 and through an inlet 110 to an inner annulus 102 between crossover tool 112 and housing 126, as shown by dashed fluid flow lines with directional arrows. Fracturing fluid then flows through inner annulus 102 and through discharge opening 118 and discharge opening 122 to outer annulus 104, as also shown by dashed fluid flow lines.

The flow path through pulse fracturing device 100 passes over a sliding sleeve 114. Discharge opening 118 is formed through sleeve 114. Although only one of discharge opening 118 is shown in the cross section represented in FIG. 1, multiple of such openings may be provided, each aligned with a respective discharge opening 122. The combination of sleeve 114, discharge opening 118, and a coil spring 124 form a normally open first valve in extension housing 126. Coil spring 124 functions as a biasing device. Other known biasing devices are conceivable that may bias the first valve in an open position configured to allow fluid discharge through the wall of extension housing 126. Spring 124 is located between sleeve 114 and extension housing 126, but spring 124 or another biasing device might be located differently and yet accomplish the biasing function.

In function, the first valve may be a type of excess flow valve. An excess flow valve may be configured to close at a predetermined level of hydrodynamic force exerted on the first valve and to open when force drops below the predetermined level. Excess flow valves are a type of check valve designed to close when flow exceeds a safe level and to reset automatically. Excess flow valves are known for use on compressed air hoses leading to pneumatic components. However, use of an excess flow valve, or the like, is not known in a downhole hydraulic fracturing device.

Figure 5:
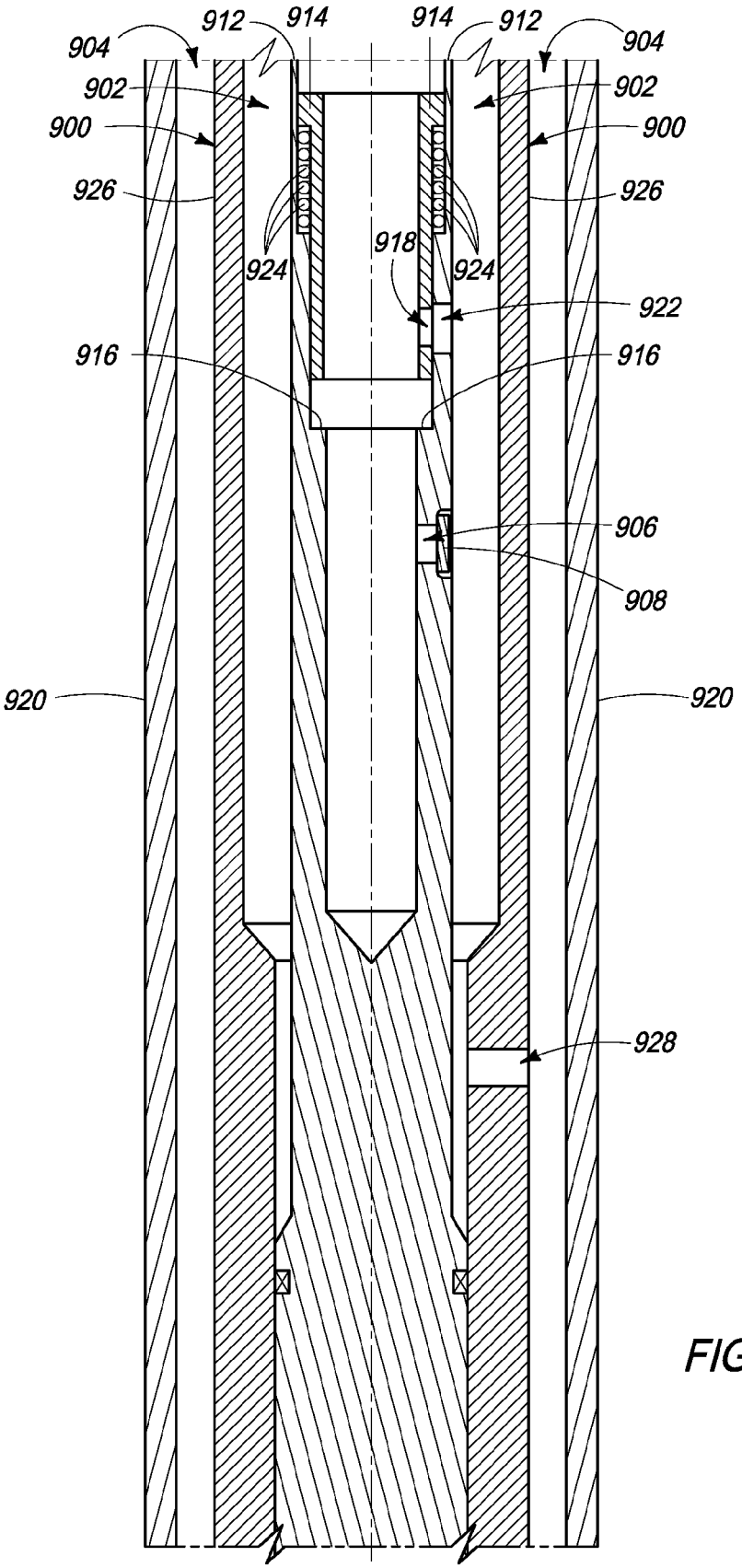
FIG. 5 shows a partial cross-sectional view of a pulse fracturing device, according to another embodiment, in a well casing.

In FIG. 1, the first valve including the combination of sleeve 114, discharge opening 118, and a coil spring 124 is shown in extension housing 126 or, more specifically, within inner annulus 102 between crossover tool 112 and extension housing 126. The first valve may also be in crossover tool 112. FIG. 5 shows another embodiment for a pulse fracturing device 900 wherein a first valve including the combination of a sliding sleeve 914, a discharge opening 918, and a coil spring 924 is in a crossover tool 912. Notably, due to its position, the first valve in FIG. 5 would also be considered to be in an extension housing 926, however, it is not within an inner annulus 902 between crossover tool 912 and extension housing 926. FIG. 5 is discussed further below.

Figure 2:
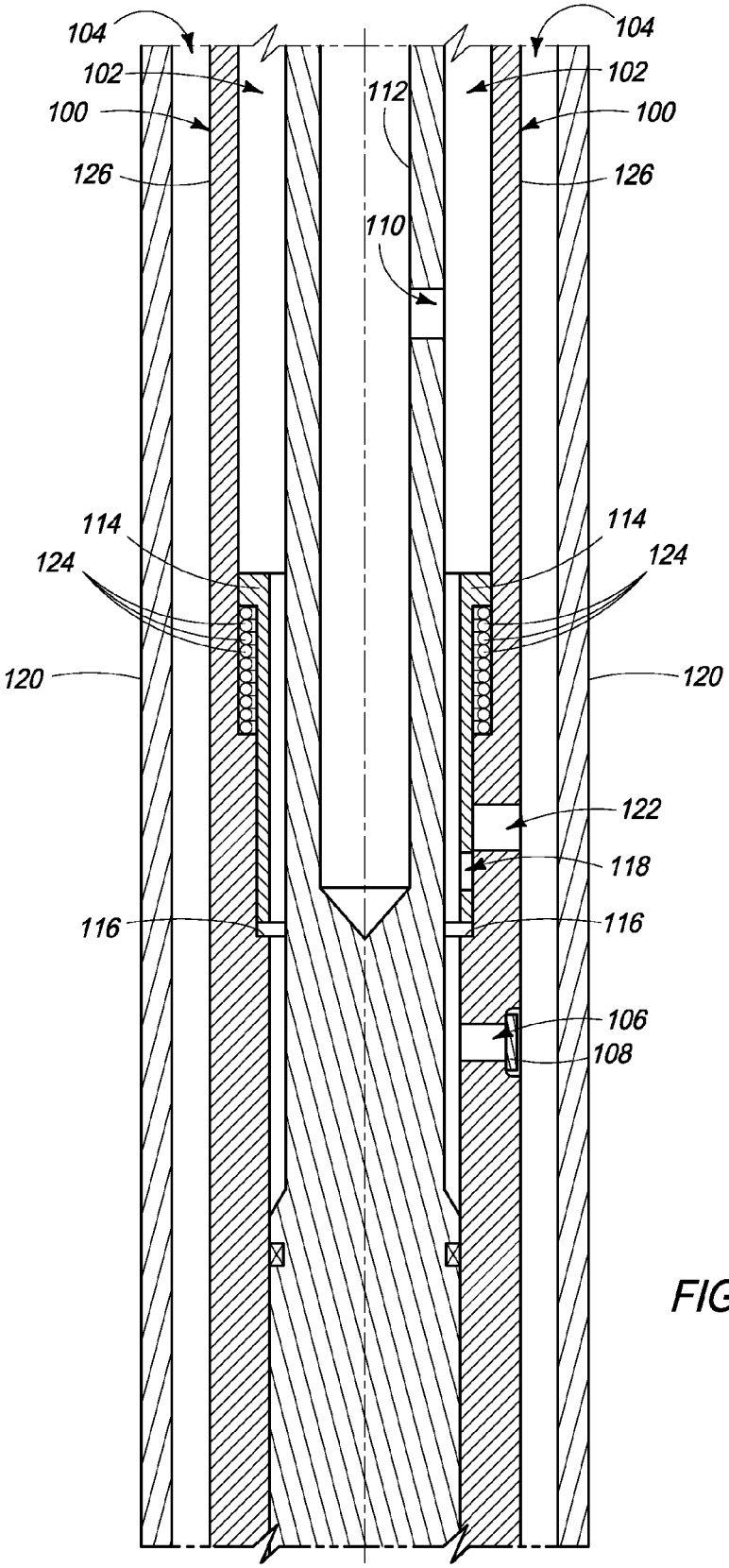

FIG. 2 shows sleeve 114 moved to a closed position, stopping the flow of fracturing fluid through discharge opening 122. The travel of sleeve 114 in sliding downward toward a seat 116 is limited by the position of seat 116. Even though sleeve 114 is not shown touching seat 116, the closed position may be considered any position of sleeve 114 from the point where sleeve 114 completely covers discharge opening 122 to the point where sleeve 114 contacts seat 116. Seat 116 may serve the function of reducing binding of the coils of spring 124 due to over-compression and resulting overlapping of coils.

The continued pumping of fracturing fluid into crossover tool 112 increases the pressure of the fracturing fluid. Pulse fracturing device 100 also includes a flap 108 mounted on extension housing 126 over a fluid outlet 106. Although only one of outlet 106 is shown in the cross section represented in FIG. 2, multiple of such openings may be provided. Discharge opening 122 and outlet 106 may be aligned so as to appear in the same cross section, as shown, or may be aligned differently depending on mechanical and/or flow path considerations. Flap 108 may be biased in a closed position (shown in FIG. 2) in any known manner. Flap 108 thus biased forms a normally closed second valve in extension housing 126. Biasing devices for known flapper valves may be used.

In function, the second valve may be a type of pressure relief valve. A pressure relief valve may be configured to open at a predetermined pressure within extension housing 126 and to close when pressure drops below the predetermined pressure. Pressure relief valves are a type of valve designed to open when pressure exceeds a safe level and to reset automatically. Pressure relief valves are known for use on a wide variety of pressurized vessels to avoid rupture by venting pressure before rupture. However, use of a pressure relief valve, or the like, is not known in a downhole hydraulic fracturing device.

FIG. 2 shows the second valve including flap 108 in extension housing 126, even though it is not within inner annulus 102. The second valve may also be in crossover tool 112. FIG. 5 shows another embodiment for pulse fracturing device 900 wherein a second valve including a flap 908 is in crossover tool 912. Notably, due to its position, the second valve in FIG. 5 would also be considered to be in extension housing 926, however, it is not within inner annulus 902 between crossover tool 912 and extension housing 926. FIG. 5 is discussed further below.

Figure 3:
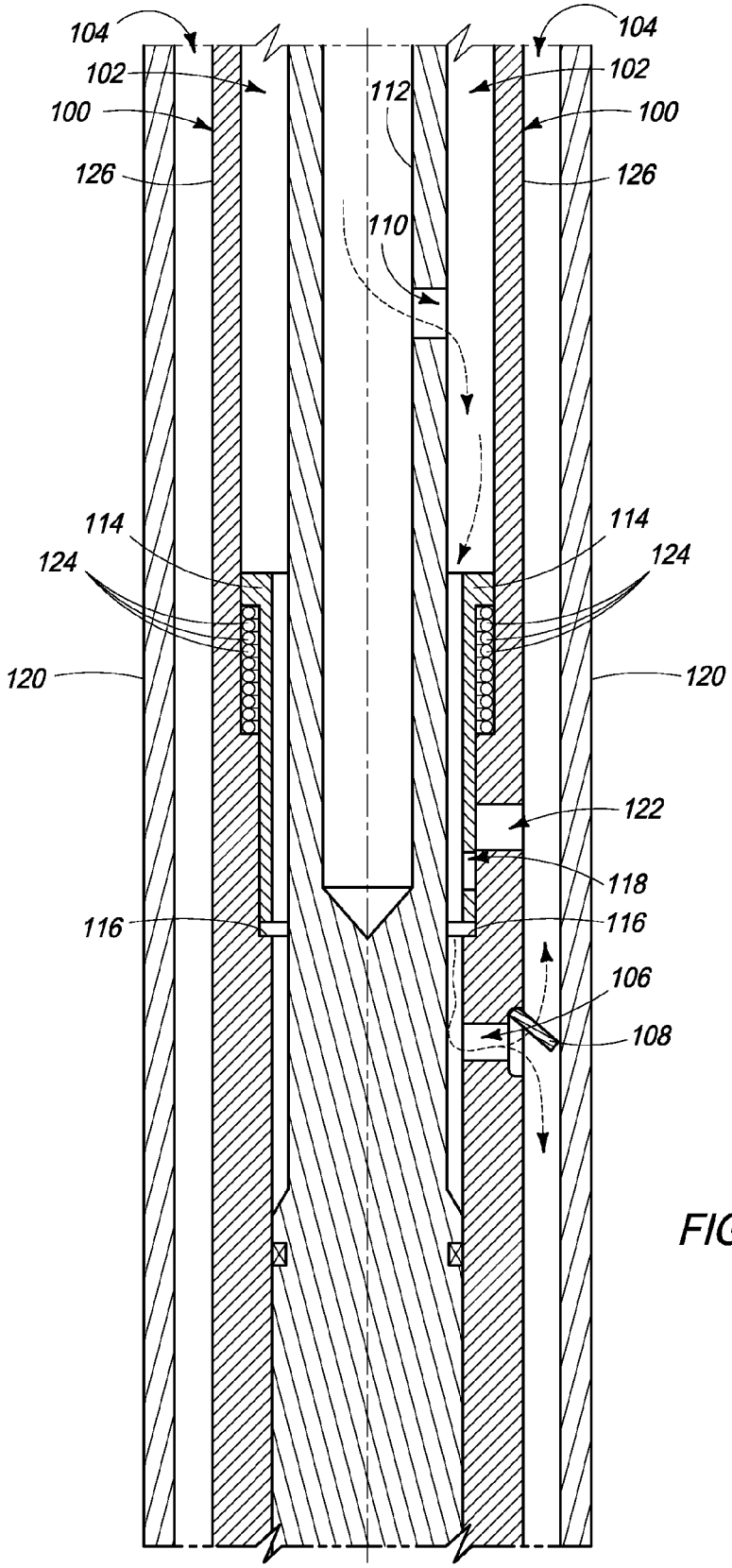

FIG. 3 shows the release of fracturing fluid from flap 108 through outlet 106 at the predetermined pressure accumulated within extension housing 126. The pulse of increased pressure flows into outer annulus 104 for distribution through perforations or ports and into the subsurface formation. During the pulse of increased pressure, FIG. 3 shows fracturing fluid along with proppant, if any, flowing through crossover tool 112 and through inlet 110 to inner annulus 102 between crossover tool 112 and housing 126, as shown by dashed fluid flow lines with directional arrows. Fracturing fluid then flows through inner annulus 102 and through outlet 106, as also shown by dashed fluid flow lines. Sleeve 114 remains in the closed position until hydrodynamic force drops below the predetermined level that triggered the closing of the first valve. Similarly, flap 108 remains in the open position until pressure drops below the predetermined pressure that triggered opening of the second valve.

A variety of possible considerations exist for the first valve, or the excess flow valve, and for the second valve, or the pressure release valve. The predetermined settings for force and pressure, the response time of the first and second valves, the fluid viscosity, the fluid flow rate, the comparative sizes of discharge openings 118/122 and outlet 106, and other parameters may influence the sequence in which sleeve 114 opens and flap 108 closes. If a different valve structure than shown in FIGS. 1-5 is selected for the excess flow valve and/or the pressure relief valve, then other considerations may influence the sequence in which the excess flow valve opens and the pressure relief valve closes.

Figure 4:
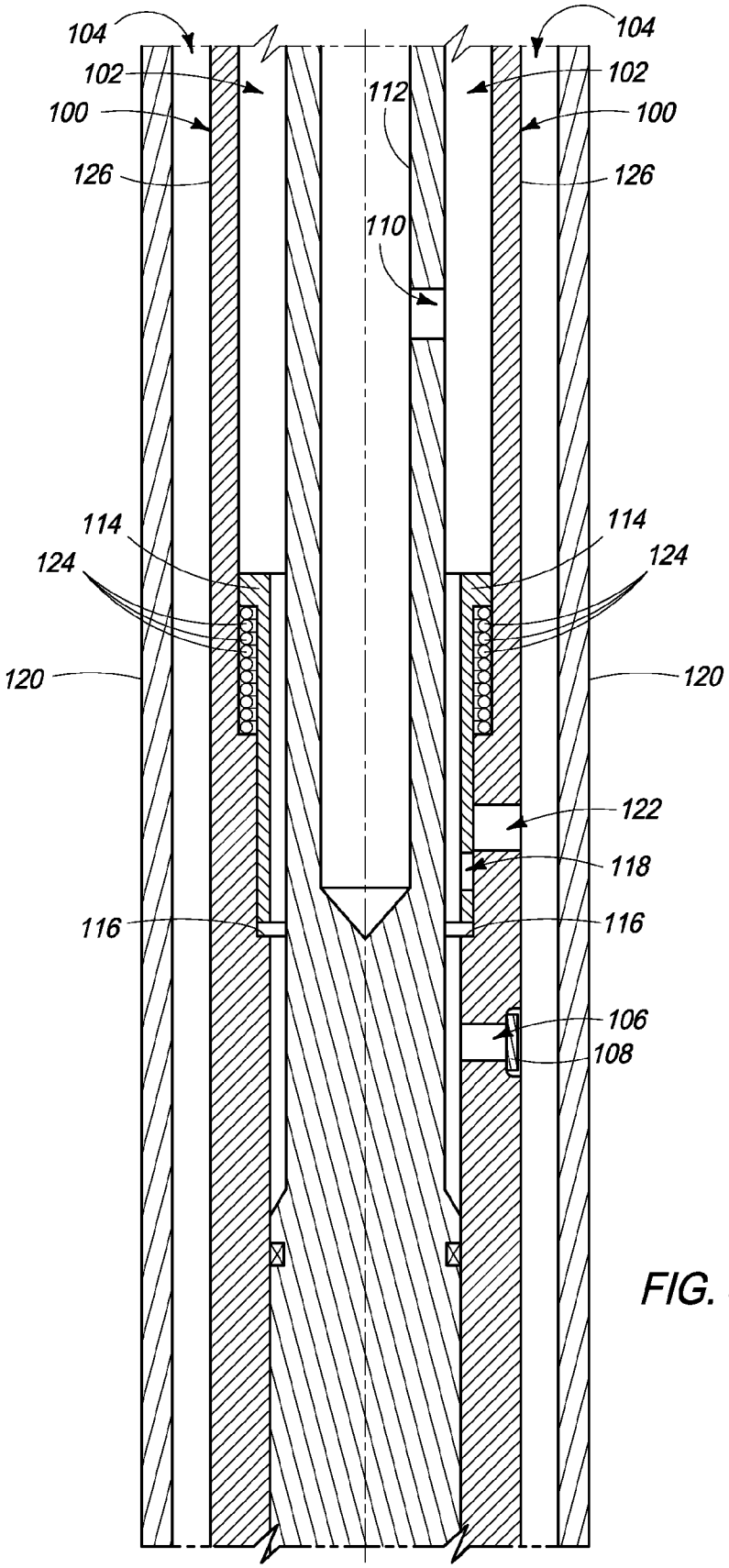

FIG. 4 shows the sequence expected for most configurations of the first and second valve. Namely, after the release of pressure shown in FIG. 3, the pulse of increased pressure ends, flap 108 closes, and sleeve 114 is still closed, but is about to open. Once sleeve 114 returns upward to the open position by spring 124 counteracting against any hydrodynamic force that may be present, the pulse cycle returns to the state shown in FIG. 1 and may begin again. Another sequence (not shown) that may be operable includes the pulse of increased pressure ending, sleeve 114 opening, and flap 108 closing thereafter to begin the pulse cycle again.

Figure 9:
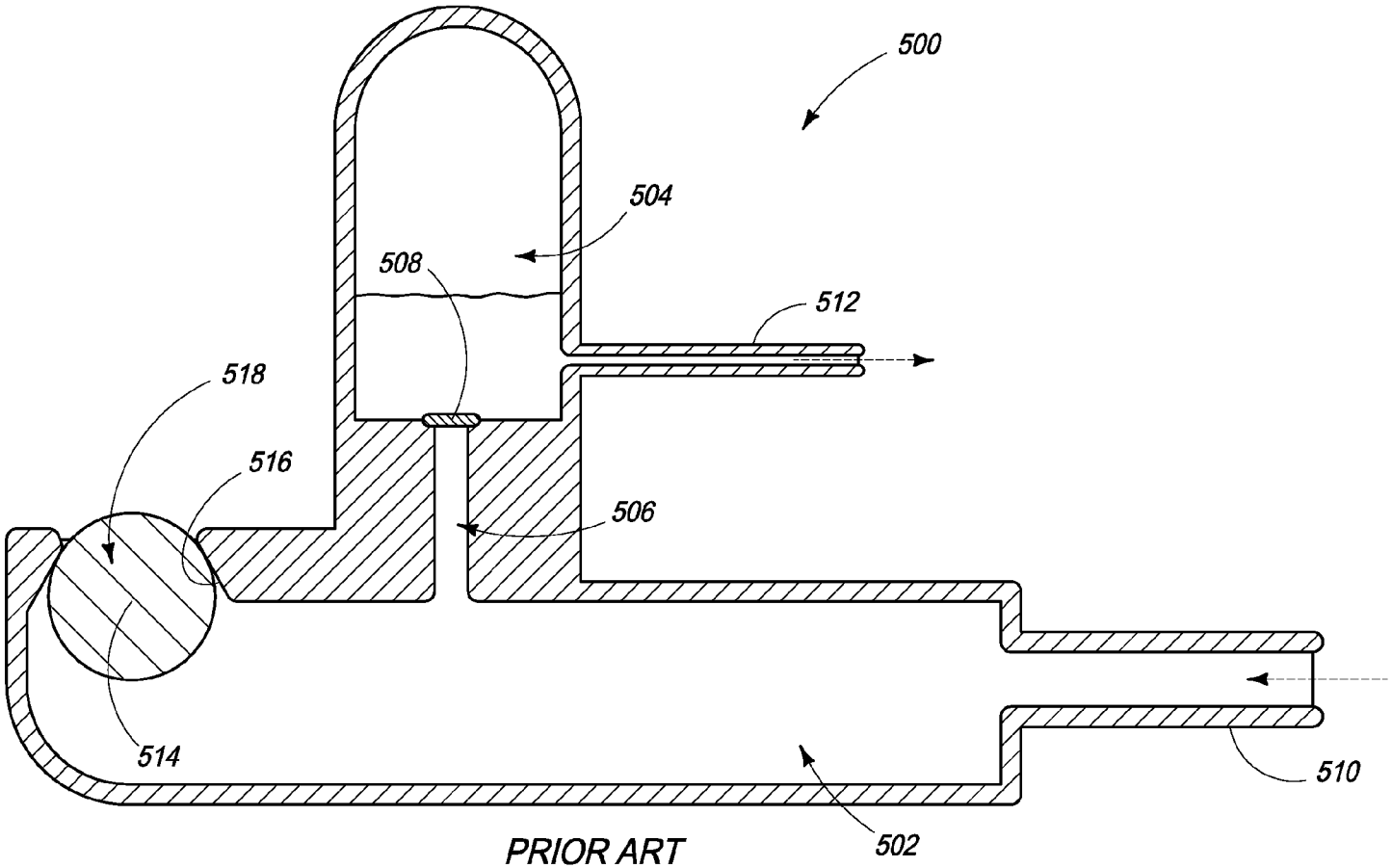
PRIOR ART FIG. 9

FIG. 5 shows an alternate embodiment at a state in the pulse cycle that corresponds with FIG. 1. An outer annulus 904 between pulse fracturing device 900 and casing 920 receives fracturing fluid, which may contain proppant, from device 900. Fracturing fluid flows through outer annulus 904, through perforations or ports (not shown) in casing 920 and ultimately into a subsurface formation, as discussed for device 100 in FIG. 1. Device 900 includes a crossover tool 912 inserted into a housing 926, as with device 100. Crossover tool 912 and housing 926 in FIG. 9 are functionally, as well as structurally, very similar to crossover tool 112 and housing 126.

However, in FIG. 5, fracturing fluid along with proppant, if any, flows through crossover tool 912 and through discharge opening 918 and discharge opening 922 in a wall of crossover tool 912 to inner annulus 902. Fracturing fluid then flows through inner annulus 902 and through outlet 928 to outer annulus 904. The flow path through pulse fracturing device 900 passes over sleeve 914. A seat 916 limits travel of sleeve 914 in like manner to seat 116 in FIG. 1. Flap 908 is mounted on crossover tool 912 over a fluid outlet 906, as for flap 108, which is instead mounted on extension housing 126. Flap 908 may be biased in a closed position in any known manner.

It will be appreciated that, when sleeve 914 closes due to hydrodynamic force, the pulse cycle shown in FIGS. 1-4 may proceed in like manner for pulse fracturing device 900, given the functional and structural similarities. Fracturing fluid may be released from flap 908 through outlet 906 at the predetermined pressure accumulated within crossover tool 912. The pulse of increased pressure flows into inner annulus 902 and through outlet 928 to outer annulus 904. Sleeve 914 remains in the closed position until hydrodynamic force drops below the predetermined level that triggered the closing of the first valve. Similarly, flap 908 remains in the open position until pressure drops below the predetermined pressure that triggered opening of the second valve.

The combination of an excess flow valve and a pressure relief valve is known in the context of a hydraulic ram. A hydraulic ram has been used for decades to pump water from a flowing stream to a higher point using the kinetic energy of the stream. No other power supply is required, but the ram is highly inefficient, using a large volume of water compared to a relatively small volume of water pumped. Although use of a hydraulic ram in a downhole device is not known, especially not in a gravel pack system extension or crossover tool, the theory behind a hydraulic ram is instructive to appreciate how the pulse fracturing device described above may operate.

Figure 6:
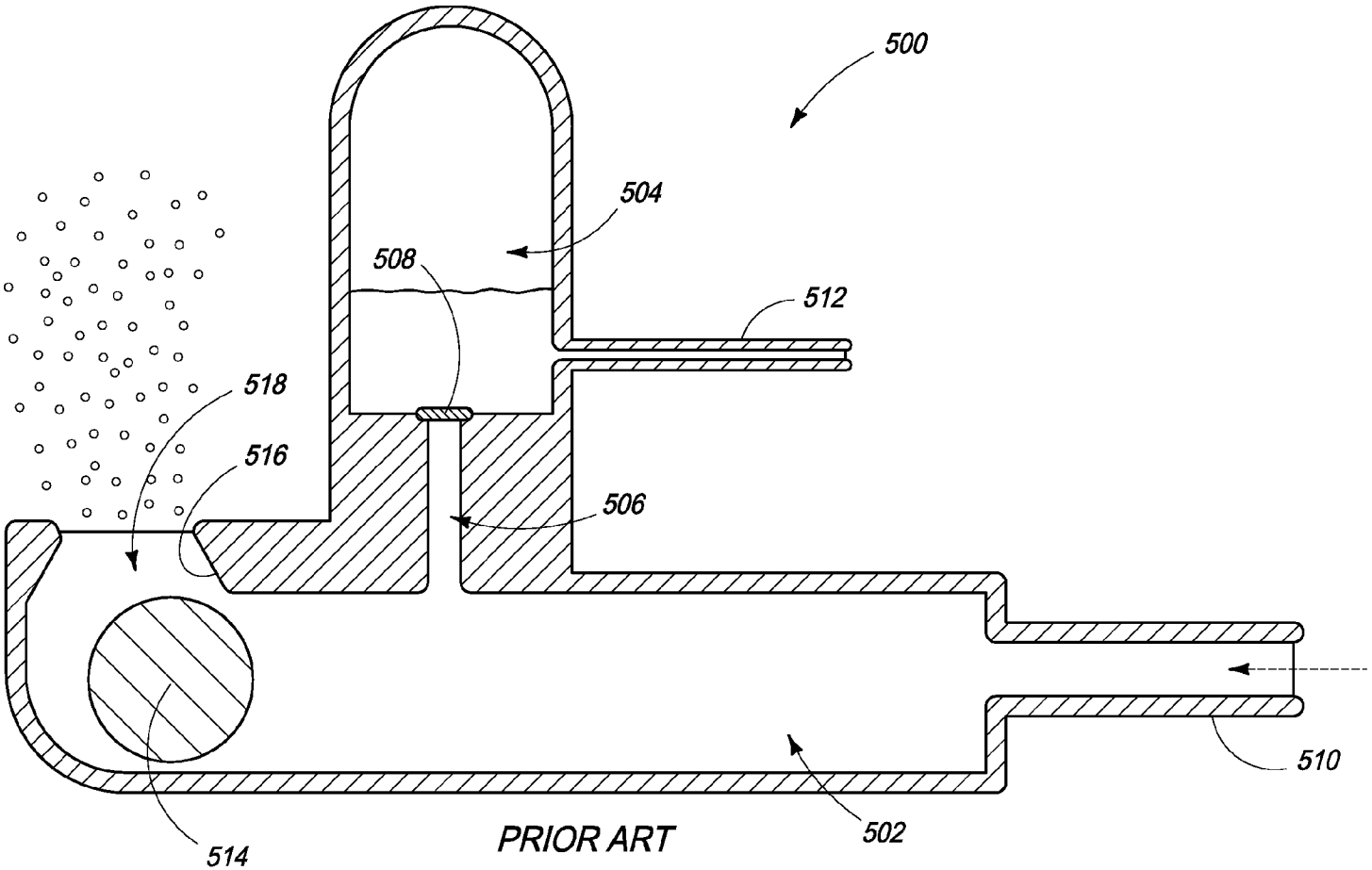
PRIOR ART FIG. 6
FIGS. 6-9 show cross-sectional views of a prior art hydraulic ram at sequential stages of a cycle that pumps inlet fluid to an increased outlet pressure.
Figure 7:
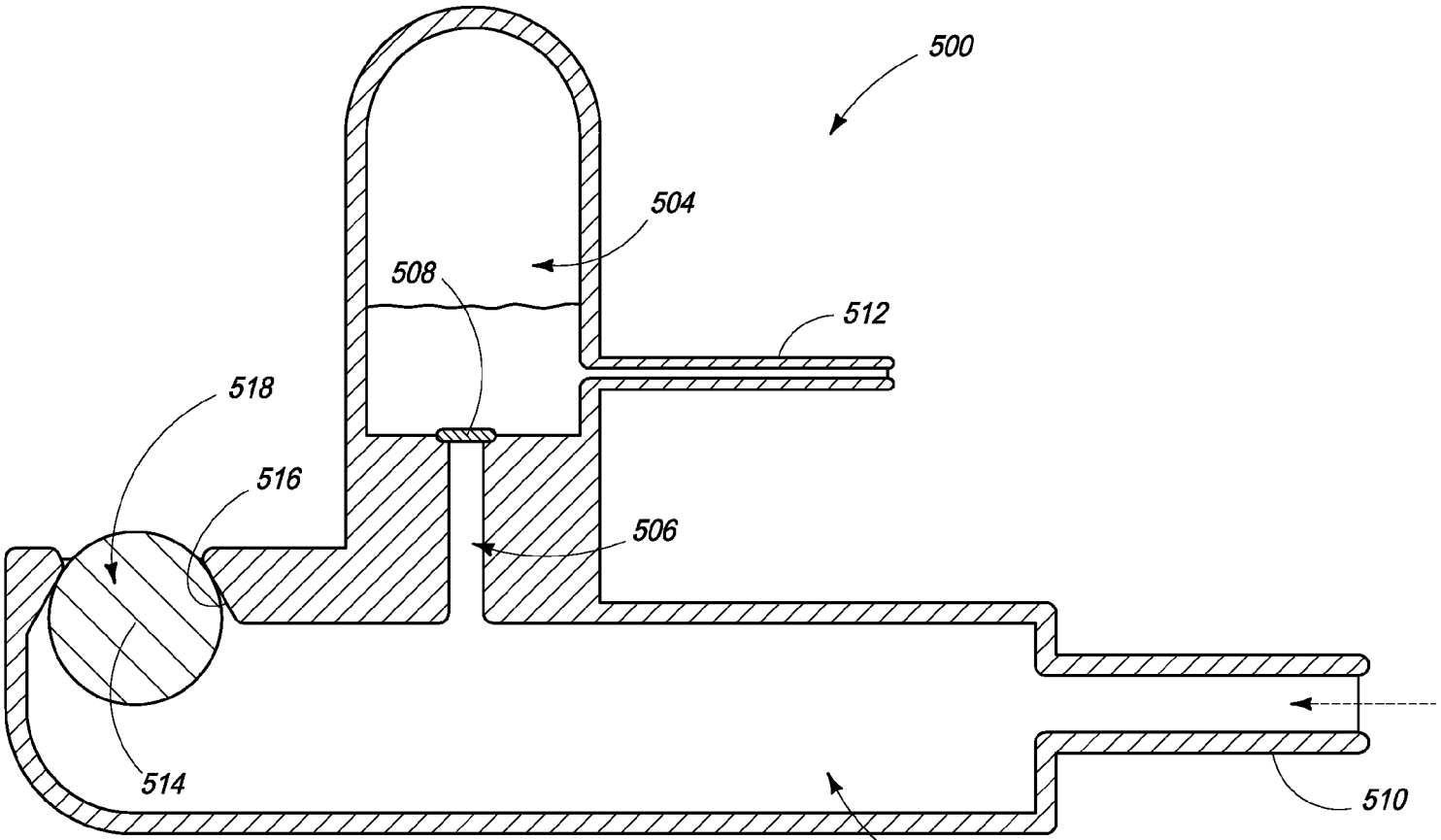
PRIOR ART FIG. 7

FIG. 6 shows a hydraulic ram 500 including a water chamber 502, an air chamber 504, and a port 506 fluidically connecting water chamber 502 to air chamber 504. An inlet pipe 510 allows a flow of water into water chamber 502. Often, the source for the flow of water is a stream or a diversion from another supply of moving water. The volume of water from the source is generally high compared to the amount desired to be pumped, but the pressure is generally low, perhaps even atmospheric pressure in case of an open channel. Kinetic energy of water flowing into water chamber 502 and out discharge opening 518 pushes ball 514 into contact with ball seat 516, as shown in FIG. 7. With water chamber 502 closed, a pressure spike occurs from the momentum of water continuing to flow in through inlet pipe 510.

Figure 8:
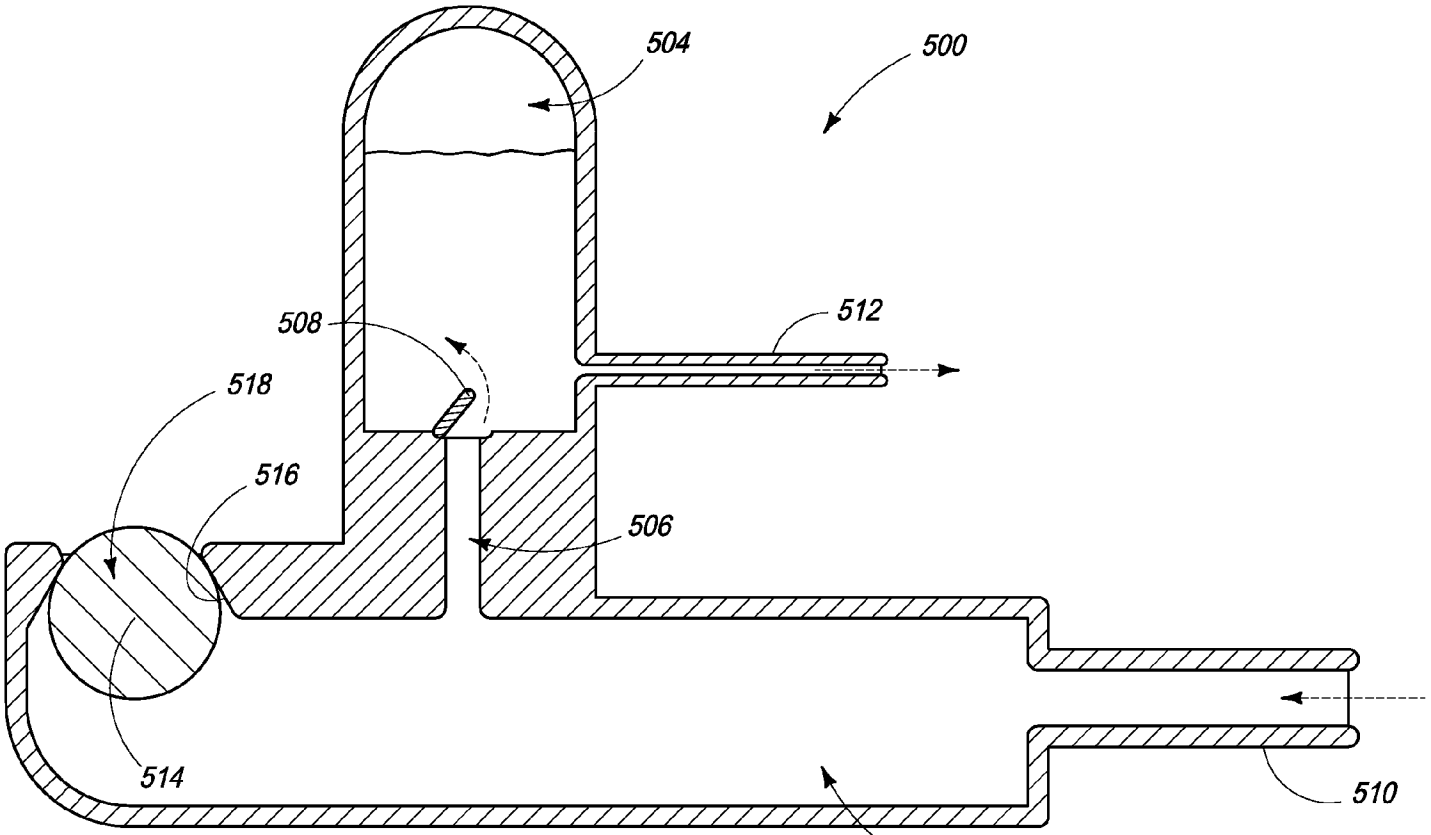
PRIOR ART FIG. 8

A flap 508 is positioned in air chamber 504 over port 506 with a column of water over flap 508, keeping it closed. The pressure spike in water chamber 502 overcomes the pressure of the water column, forcing flap 508 open and flowing into air chamber 504 and through outlet pipe 512, as in FIG. 8. Water flows through outlet pipe 512 at a higher pressure than it entered inlet pipe 510, allowing it to be pumped elsewhere. The incoming water compresses the air in air chamber 504 until the combined pressure of the column of water and compressed air forces flap 508 closed again, as in FIG. 9. The compressed air continues to push water through outlet pipe 512 in FIG. 9.

In addition to forcing flap 508 open, the pressure spike creates a very small velocity backward against the water flowing into water chamber 502. The combination of the velocity backward and the release of pressure into air chamber 504 allows ball 518 to fall from contact with ball seat 516. At that point, the cycle begins again at the state shown in FIG. 6.

Pulse fracturing devices 100 and 900 and variations thereof described herein may operate under analogous principles to those described for the prior art hydraulic ram in FIGS. 6-9. Devices 100 and 900 may thus be considered to include hydraulic rams. One notable difference is that devices 100 and 900 do not include an air chamber. Instead, an analogous structure is provided in the form of bias on flaps 108 and 908 to keep them normally closed and to allow pressure to build when sleeves 114 and 914 move to a closed position.

Another difference is that water flowing through discharge opening 518 in hydraulic ram 500 is wasted and normally returns to the stream of water from whence it came, separating it from the water pumped through port 506. For a hydraulic ram in devices 100 and 900, fracturing fluid flowing through discharge openings 118 and 918 is subsequently commingled with fracturing fluid flowing through outlets 106 and 906. Indeed, the pressure pulse generated from devices 100 and 900 propagates through the fracturing fluid that flows from discharge openings 118 and 918 into the subsurface formation.

According to a further embodiment, a pulse fracturing method includes positioning an upper packer, a lower packer, and an extension housing in a well casing in a subsurface formation. At least a portion of the extension housing is between the upper packer and the lower packer. The method includes isolating a portion of the well casing between the upper and lower packers and flowing fracturing fluid through a hydraulic ram to the isolated well casing. The hydraulic ram is located in the extension housing. The hydraulic ram cyclically produces pulses of increased pressure originating from the hydraulic ram. The method further includes fracturing the subsurface formation using the fracturing fluid and pressure pulses.

By way of example, the pulse fracturing method may further include inserting a crossover tool into the extension housing, no part of the hydraulic ram being in the crossover tool. Instead, the method may further include inserting a crossover tool into the extension housing, the hydraulic ram being in the crossover tool. The hydraulic ram may be entirely located between the upper packer and the lower packer.

The hydraulic ram may include a normally open first valve in the extension housing. While flowing fracturing fluid through the hydraulic ram, the method may include the first valve closing at a predetermined level of hydrodynamic force exerted on the first valve and opening when force drops below the predetermined level. The first valve, when open, may allow fluid flow out from the extension housing between the upper packer and the lower packer. The hydraulic ram may additionally include a normally closed second valve in the extension housing. While flowing fracturing fluid through the hydraulic ram, the method may include the second valve opening at a predetermined pressure within the extension housing and closing when pressure drops below the predetermined pressure. The second valve when open, may allow fluid flow out from the extension housing between the upper packer and the lower packer.

In the context of using known gravel pack systems, the crossover tool may be placed in one of a variety of positions at certain stages in gravel packing to accomplish the process. System extensions can be added to increase the flexibility of circulation modes. When a crossover tool seals into an upper packer in the "squeeze" position, no circulation occurs and all fluid pumped through the crossover tool ultimately flows into the formation. Depending on the porosity of the formation, the squeeze position may generate a low flow condition.

In a "circulate" position, fluid flows through the crossover tool, through the housing into the outer annulus between the housing and the well casing, through the gravel pack, back in through another part of the housing, and into a wash pipe of the crossover tool. One purpose of the crossover tool is then to allow flow from the wash pipe to enter an annulus above the upper packer between the crossover tool and well casing and to return to the surface. The circulate position may thus be a higher flow condition compared to the squeeze position.

For a pulse fracturing method that uses a hydraulic ram, when a crossover tool is inserted into the extension housing, the method may include forming an inner annulus between the crossover tool and the extension housing. At least a portion of the hydraulic ram may be within the inner annulus. The crossover tool may be in a circulate position with respect to the extension housing. By using the circulate position instead of the squeeze position, a higher flow rate may be obtained to operate the hydraulic ram.

The hydraulic ram may include a normally open excess flow valve and a normally closed pressure relief valve. The pressure pulses may be produced by a cycle that includes: closing the excess flow valve, increasing pressure due to blocked fracturing fluid flow through the excess flow valve, opening the pressure relief valve, releasing the increased pressure in a pulse from the pressure relief valve, closing the pressure relief valve, opening the excess flow valve, and restarting the cycle. As a result, the formation may be fatigued, enhancing fracturing operations as discussed above.

Although various embodiments have been shown and described, the present disclosure is not so limited and will be understood to include all such modifications and variations as would be apparent to one skilled in the art.

TABLE OF REFERENCE NUMERALS FOR FIGS. 1-9

| | |
|---|---|
| 100 | pulse fracturing device |
| 102 | inner annulus |
| 104 | outer annulus |
| 106 | outlet |
| 108 | flap |
| 110 | inlet |
| 112 | crossover tool |
| 114 | sleeve |
| 116 | seat |
| 118 | discharge opening |
| 120 | casing |
| 122 | discharge opening |
| 124 | coil spring |
| 126 | extension housing |
| 130 | upper packer |
| 132 | lower packer |
| 500 | hydraulic ram |
| 502 | water chamber |

-continued

TABLE OF REFERENCE NUMERALS FOR FIGS. 1-9

| | |
|---|---|
| 504 | air chamber |
| 506 | port |
| 508 | flap |
| 510 | inlet pipe |
| 512 | outlet pipe |
| 514 | ball |
| 516 | ball seat |
| 518 | discharge opening |
| 900 | pulse device |
| 902 | inner annulus |
| 904 | outer annulus |
| 906 | outlet |
| 908 | flap |
| 912 | crossover tool |
| 914 | sleeve |
| 916 | seat |
| 918 | discharge opening |
| 920 | casing |
| 922 | discharge opening |
| 924 | coil spring |
| 926 | extension housing |
| 928 | outlet |

What is claimed is:

1. A pulse fracturing device comprising:

an upper isolation mechanism, a lower isolation mechanism, and a housing at least a portion of which is between the upper isolation mechanism and the lower isolation mechanism, the upper and lower isolation mechanisms being configured to isolate a portion of a well casing;

a normally open first valve in the housing, the first valve being configured to close at a predetermined level of hydrodynamic force exerted on the first valve and to open when force drops below the predetermined level, the first valve when open being configured to allow fluid flow out from the housing between the upper isolation mechanism and the lower isolation mechanism; and a normally closed second valve in the housing, the second valve being configured to open at a predetermined pressure within the housing and to close when pressure drops below the predetermined pressure, the second valve when open being configured to allow fluid flow out from the housing between the upper isolation mechanism and the lower isolation mechanism.

2. The device of claim 1 wherein the first valve comprises an excess flow valve and the second valve comprises a pressure relief valve.

3. The device of claim 1 wherein the housing comprises a first discharge opening through a wall of the housing and the first valve comprises a sliding sleeve within the housing, the sliding sleeve having a second discharge opening through a wall of the sliding sleeve and, with the first valve open, the first discharge opening being aligned with the second discharge opening.

4. The device of claim 1 wherein the first valve is biased open by a spring.

5. The device of claim 1 wherein the second valve comprises a flap mounted on the housing over a fluid outlet through the wall of the housing.

6. The device of claim 1 wherein the upper and lower isolation mechanisms comprise upper and lower packers and the housing comprises an extension housing of a gravel pack system and further comprising a crossover tool inserted into the extension housing to form an inner annulus between the crossover tool and the extension housing, the first valve being within the inner annulus.

7. The device of claim 6 wherein the crossover tool comprises a fluid inlet into the inner annulus such that, with the first valve or the second valve in an open position, a fluid flow path is provided from the crossover tool, through the fluid inlet, through the inner annulus, and through a wall of the extension housing.

8. The device of claim 1 further comprising a crossover tool inserted into the housing, the first valve and the second valve being in the crossover tool.

9. A pulse fracturing device comprising:

an extension housing having a first discharge opening through a wall of the extension housing;

an excess flow valve including a sliding sleeve within the extension housing, the sliding sleeve having a second discharge opening through a wall of the sliding sleeve and the excess flow valve being biased in an open position with the first discharge opening aligned with the second discharge opening, the open position being configured to allow fluid discharge through the wall of the extension housing;

a pressure relief valve including a flap mounted on the extension housing over a fluid outlet through the wall of the extension housing, the relief valve being biased in a closed position; and a crossover tool inserted into the extension housing to form an inner annulus between the crossover tool and the extension housing, the sliding sleeve being within the inner annulus and the crossover tool including a fluid inlet into the inner annulus such that, with the excess flow valve or the relief valve in an open position, a fluid flow path is provided from the crossover tool, through the fluid inlet, through the inner annulus, and through the wall of the extension housing.

10. The device of claim 9 wherein the excess flow valve is biased in the open position by a spring between the sliding sleeve and the extension housing.

11. The device of claim 9 further comprising a packer, at least a portion of the extension housing being downhole from the packer, the packer being configured to isolate a portion of a well bore downhole from the packer, and the first and second discharge openings and the fluid outlet being downhole from the packer.

12. The device of claim 9 wherein the excess flow valve is configured to close at a predetermined level of hydrodynamic force exerted on the excess flow valve and to open when force drops below the predetermined level.

13. The device of claim 9 wherein the pressure relief valve is configured to open at a predetermined pressure within the extension housing and to close when pressure drops below the predetermined pressure.

14. A pulse fracturing method comprising:

positioning an upper packer, a lower packer, and an extension housing in a well casing in a subsurface formation, at least a portion of the extension housing being between the upper packer and the lower packer;

isolating a portion of the well casing between the upper and lower packers;

flowing fracturing fluid through a hydraulic ram to the isolated well casing, the hydraulic ram being located in the extension housing, and cyclically producing pulses of increased pressure originating from the hydraulic ram by cycling flow through a normally open first valve that increases pressure when closed and a normally closed second valve that releases pressure when opened; and fracturing the subsurface formation using the fracturing fluid and pressure pulses.

15. The method of claim 14 further comprising inserting a crossover tool into the extension housing, no part of the hydraulic ram being in the crossover tool.

16. The method of claim 14 wherein:

the hydraulic ram comprises a normally open first valve in the extension housing and, while flowing fracturing fluid through the hydraulic ram, the first valve closing at a predetermined level of hydrodynamic force exerted on the first valve and opening when force drops below the predetermined level, the first valve when open allowing fluid flow out from the extension housing between the upper packer and the lower packer; and the hydraulic ram additionally comprises a normally closed second valve in the extension housing and, while flowing fracturing fluid through the hydraulic ram, the second valve opening at a predetermined pressure within the extension housing and closing when pressure drops below the predetermined pressure, the second valve when open allowing fluid flow out from the extension housing between the upper packer and the lower packer.

17. The method of claim 14 further comprising inserting a crossover tool into the extension housing and forming an inner annulus between the crossover tool and the extension housing, at least a portion of the hydraulic ram being within the inner annulus and the crossover tool being in a "circulate" position with respect to the extension housing.

18. The method of claim 14 wherein the hydraulic ram comprises a normally open excess flow valve and a normally closed pressure relief valve and the pressure pulses are produced by a cycle that includes: closing the excess flow valve, increasing pressure due to blocked fracturing fluid flow through the excess flow valve, opening the pressure relief valve, releasing the increased pressure in a pulse from the pressure relief valve, closing the pressure relief valve, opening the excess flow valve, and restarting the cycle.

19. A pulse fracturing method comprising:

positioning an upper packer, a lower packer, and an extension housing in a well casing in a subsurface formation, at least a portion of the extension housing being between the upper packer and the lower packer;

isolating a portion of the well casing between the upper and lower packers;

inserting a crossover tool into the extension housing;

flowing fracturing fluid through a hydraulic ram to the isolated well casing, the hydraulic ram being in the crossover tool and located in the extension housing, and cyclically producing pulses of increased pressure originating from the hydraulic ram; and fracturing the subsurface formation using the fracturing fluid and pressure pulses.

20. A pulse fracturing method comprising:

positioning an upper packer, a lower packer, and an extension housing in a well casing in a subsurface formation, at least a portion of the extension housing being between the upper packer and the lower packer;

isolating a portion of the well casing between the upper and lower packers;

flowing fracturing fluid through a hydraulic ram to the isolated well casing, the hydraulic ram being located in the extension housing and entirely located between the upper packer and the lower packer, and cyclically producing pulses of increased pressure originating from the hydraulic ram; and fracturing the subsurface formation using the fracturing fluid and pressure pulses.

* * * * *